US012624937B2

(12) United States Patent
Liebenberg et al.

(10) Patent No.: US 12,624,937 B2
(45) Date of Patent: May 12, 2026

(54) METHOD OF MANAGING A BLAST SYSTEM

(71) Applicant: DETNET SOUTH AFRICA (PTY) LTD, Johannesburg (CA)

(72) Inventors: Abraham Johannes Liebenberg, Johannesburg (CA); Tielman Christiaan Meyer, Johannesburg (CA)

(73) Assignee: DETNET SOUTH AFRICA (PTY) LTD, Johannesburg (ZA)

( * ) Notice: Subject to any disclaimer, the term of this patent is extended or adjusted under 35 U.S.C. 154(b) by 0 days.

(21) Appl. No.: 18/862,897

(22) PCT Filed: Sep. 1, 2023

(86) PCT No.: PCT/ZA2023/050053
§ 371 (c)(1),
(2) Date: Nov. 4, 2024

(87) PCT Pub. No.: WO2024/055050
PCT Pub. Date: Mar. 14, 2024

(65) Prior Publication Data

US 2025/0314471 A1 Oct. 9, 2025

(30) Foreign Application Priority Data

Sep. 5, 2022 (ZA) ..... 2022/09857

(51) Int. Cl.
*F42D 1/055* (2006.01)
*F42D 1/045* (2006.01)

(52) U.S. Cl.
CPC ..... *F42D 1/045* (2013.01)

(58) Field of Classification Search
CPC . F42D 3/04; F42D 1/045; F42D 1/055; F42D 1/08; F42D 1/00; E21B 7/025; E21D 9/006; G06F 30/20; G06F 30/00
See application file for complete search history.

(56) References Cited

U.S. PATENT DOCUMENTS 5,038,682 A * 8/1991 Marsden ..... F42C 13/047 102/220
2014/0311370 A1* 10/2014 Koekemoer ..... F42C 11/001 102/217

(Continued)

FOREIGN PATENT DOCUMENTS

WO 2022/073042 A1 4/2022
WO 2022/073043 A1 4/2022

OTHER PUBLICATIONS

International Search Report and Written Opinion for Application No. PCT/ZA2023/050053 dated Dec. 4, 2023 (10 pages).

*Primary Examiner* — Michael D David
(74) *Attorney, Agent, or Firm* — Michael Best & Friedrich LLP

(57) ABSTRACT

A blasting system (10) wherein a test through-the-earth signal of predetermined strength is sent from a defined position and the strength of the signal, as received at each of a plurality of locations (24) within a blast site, is measured thereby to enable an operative zone (56) to be defined wherein at any location within the operative zone a fire command through-the-earth magnetic signal, of such predetermined strength, transmitted from the defined position, as received at such location, will have a strength above a threshold signal strength.

7 Claims, 3 Drawing Sheets

(56) References Cited

U.S. PATENT DOCUMENTS

| | | | | |
|---|---|---|---|---|
| 2023/0280140 | A1* | 9/2023 | Kotsonis, III | F42D 1/045<br>361/248 |
| 2023/0417525 | A1* | 12/2023 | Muller | F42D 1/045 |

* cited by examiner

METHOD OF MANAGING A BLAST SYSTEM

CROSS-REFERENCE TO RELATED APPLICATIONS

This application is a national phase entry of PCT/ZA2023/050053, filed on Sep. 1, 2023, which claims priority to South African Application Number 2022/09857, filed on Sep. 5, 2022, the entire contents of both of which are fully incorporated herein by reference.

BACKGROUND OF THE INVENTION

This invention relates to a method of managing a blasting system which is based on the use of through-the-earth magnetic signal transmission.

A blasting system of the kind referred to typically includes a site which includes a plurality of spaced apart boreholes into which respective detonator assemblies are deployed after tagging, and a transmitter at the site for transmitting through-the-earth magnetic command signals via an antenna from a blast controller to the detonator assemblies.

A field strength survey is conducted at the site, beforehand, by placing a plurality of magnetic field strength meters (MFSMs) at respective spaced apart locations at the site to measure the received signal strengths of a through-the-earth magnetic signal (a test signal) at the respective locations to determine a range of transmission of the antenna.

As boreholes, for practical reasons, are often drilled before the field strength survey is conducted, workers at the site could inadvertently tag and load a detonator assembly into a borehole at which the received signal strength of the test signal is too low for reliable operation. A command signal from the blast controller might then not be received by that detonator assembly which may (inadvertently) have been included in a blast plan. As a result the detonator assembly might not receive a fire command signal and, in that event, will not be fired. This leads to a dangerous situation because a misfired detonator could be present at the time of excavation of a rock body in which the detonator assembly was placed and could detonate with a likelihood of causing injury to or death of personnel, and damage to equipment.

An object of the invention is to address at least to some extent the aforementioned situation.

SUMMARY OF THE INVENTION

The invention provides a method of managing a blasting system at a site which includes the steps of transmitting a through-the-earth magnetic signal of a predetermined signal strength from an antenna which is located at a predetermined position, at each of a plurality of spaced apart locations at the site obtaining positional data of the location and obtaining a measure of the strength of the through-the-earth magnetic signal as received at the location, using the positional data and the measures of the received signal strength to define an operative zone, at the site, within which operative zone each of the measures of the received signal strength is above a threshold value, deploying a plurality of detonator assemblies at spaced apart positions at the site, allowing a detonator assembly to be tagged and thereby to be included in the blasting system only if the position of the detonator assembly is situated within the operative zone and, in use, locating the antenna at said predetermined position and transmitting from the antenna to each tagged detonator assembly a fire command signal which has a signal strength which is equal to or greater than said predetermined signal strength.

The through-the-earth magnetic signal may be sent from the antenna via a transmitter at a blast controller at the site.

At each of the plurality of spaced apart locations use may be made of at least one magnetic field strength meter (MFSM) which includes a receiver which is responsive to the received through-the-earth magnetic signal thereby to obtain a measure of the strength of that received signal at that location.

The measure of the strength of the received magnetic signal and, optionally, the positional data of the location of the MFSM may be stored in a memory module of the respective MFSM. The positional data (for acceptable received signal strength) is used to define a geographical boundary of the zone which, for the purposes of the invention, is an operative zone within which detonator assemblies can be reliably deployed. It is therefore convenient and useful to have the positional data of the relevant MFSMs transferred to memory in a tagger, or similar device, for easy access while establishing the blasting system.

The MFSMs are preferably positioned at respective spaced apart locations at or near a boundary of the site.

In one embodiment each MFSM includes a respective identifier which is stored in the memory module of the MFSM. The identifier may be linked to the measure of the strength of the received magnetic signal and the positional data.

The method may extend to the use of at least one tagger to scan each MFSM thereby to read and then store in the tagger the respective positional data of the location of that MFSM.

Any suitable technique may be used to obtain the positional data. In one form of the invention the tagger is used to scan each MFSM thereby to operate a GPS module included within the tagger to produce the respective positional data.

In another form of the invention the tagger is used to scan a respective MFSM thereby to operate a receiver which is included within the tagger and which is responsive to beacon signals from respective beacons positioned at spaced apart locations at the site. The tagger may then use the beacon signals to determine positional data which is dependent on the locations of the beacons.

Alternatively, each MFSM may be used to produce the respective positional data and may have appropriate positional data determining capabilities. For example each MFSM may include a respective GPS module, or a respective receiver responsive to beacon signals, which can be used to determine the positional data of the MFSM when the strength of the received through-the-earth magnetic signal is measured.

Each tagger may be used to scan a respective MFSM and then to store the positional data, the measure of the strength of the received magnetic signal, and a unique identifier of the MFSM in a memory module included within each tagger.

It is possible to use the positional data as the unique identifier of the MFSM.

Each tagger may be operable to transfer the stored data from its memory module to a processor at a data collection point which is configured to use the positional data and the measures of the received signal strength thereby to define the zone (the operative zone referred to) within which each of the measures of the received signal strength is above the threshold value.

The threshold value may be defined such that the detonator assemblies can reliably receive the fire command signal if the received signal strength of the fire command signal is above the threshold value at the respective locations. Thus the strength of the transmitted fire command signal is equal to or greater than the aforementioned predetermined signal strength. The respective detonator assemblies are unable to reliably receive the fire command signal if the received signal strength is below the threshold value at the relevant locations.

Boundary details of the defined operative zone may be stored in the memory module of each tagger.

The tagger may be used to scan each detonator assembly to determine the position of the detonator assembly. The detonator assembly can then only be tagged if the position of the detonator assembly is situated within the defined operative zone.

Each detonator assembly may be loaded into a respective borehole located within the operative zone after the detonator assembly has been tagged. Tagging is not possible if the physical location of the detonator is outside of the operative zone for, inherently, a misfire of a detonator assembly might occur if the detonator assembly were to be loaded into a borehole which is outside the operative zone.

The predetermined position of the antenna may be ascertained and logged in any suitable way. Positional data of the antenna may be determined by means of a GPS module, a receiver for receiving beacon signals from respective beacons, an accelerometer for determining movement of the antenna from a known location, an NFC chip which can be scanned by a tagger with positional data determining means, or the like. The invention is not limited in this respect.

Positional data of the antenna are preferably determined prior to transmitting the through-the-earth magnetic signal from the antenna, said positional data comprising the predetermined position of the antenna. Thereafter new positional data of the antenna are determined prior to transmitting the fire command signal from the antenna, and allowing the blast controller to generate the fire command signal only if the new positional data corresponds with the predetermined position of the antenna. In other words the antenna, when used for transmitting the fire command signal, must be in the position it occupied when the aforementioned through-the-earth magnetic signal of predetermined signal strength was transmitted.

The invention also provides a blasting system which includes a blasting site at which is defined an operative zone, a plurality of explosive-charged boreholes located within the operative zone, a plurality of detonator assemblies, each detonator assembly being deployed in a respective borehole, each detonator assembly including a respective receiver which is responsive to receipt of a fire command signal, wherein the strength of such received signal is greater than a pre-established threshold value, and a blast controller configured to transmit a through-the-earth magnetic fire command signal which, at each borehole in the operative zone, has a signal strength greater than said threshold value.

BRIEF DESCRIPTION OF THE DRAWINGS

The invention is further described by way of example with reference to the accompanying drawings in which.

DESCRIPTION OF PREFERRED EMBODIMENT

Figure 1:
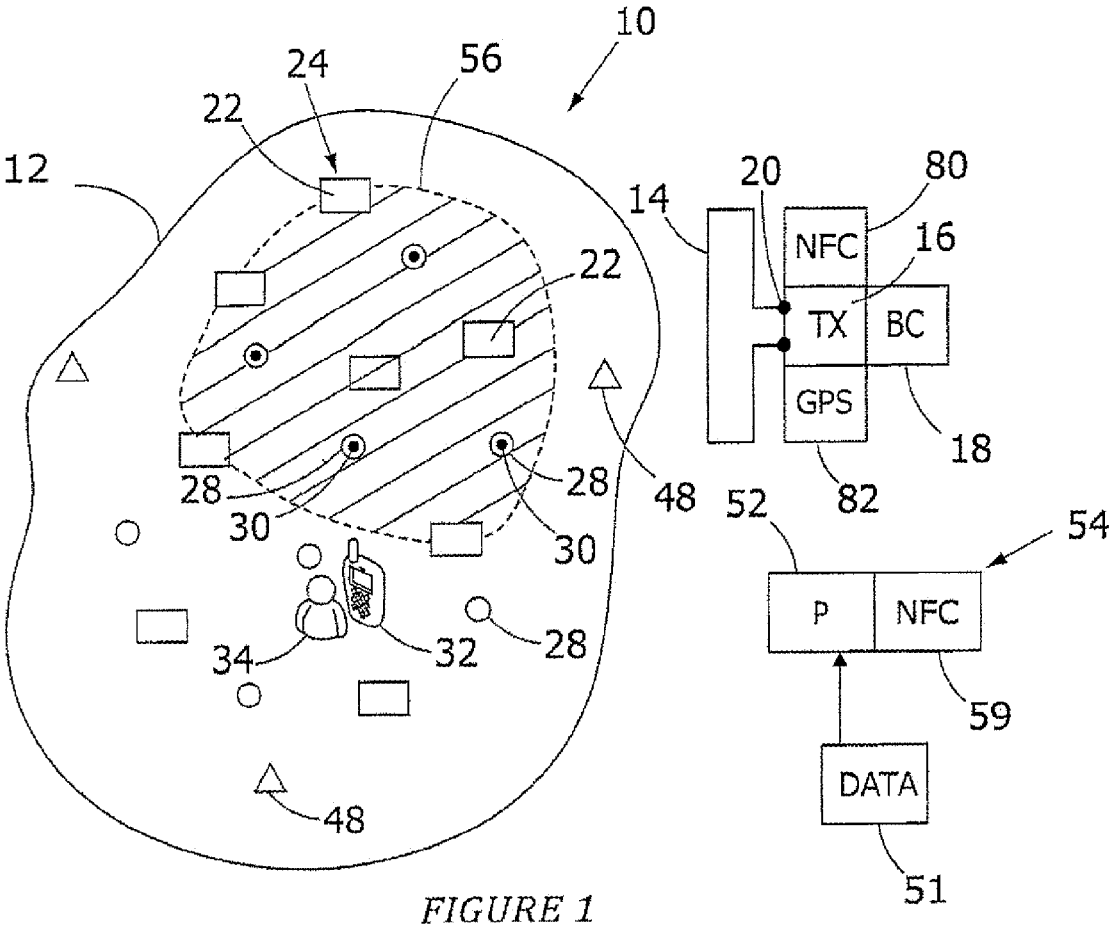
FIG. 1 schematically depicts various aspects of a blasting system according to the invention.

FIG. 1 of the accompanying drawings schematically depicts various aspects of a blasting system 10 according to the invention.

The blasting system 10 is established at a site 12, and includes an antenna 14 which is connected to a transmitter 16 at a blast controller 18. The antenna 14 forms a loop and is connected to the transmitter 16 by means of input terminals 20.

A plurality of magnetic field strength meters 22 (MFSMs) are respectively positioned at spaced apart locations 24 at the site 12. The site 12 includes a plurality of spaced apart boreholes 28 in which a plurality of respective detonator assemblies 30 are to be loaded. At least one tagger 32 is provided at the site 12 which is operable by a user 34 as described hereinafter.

The antenna 14 is shown displaced from the site 12 but typically could surround a number of the boreholes 28 and the MFSMs 22.

Figure 2A:
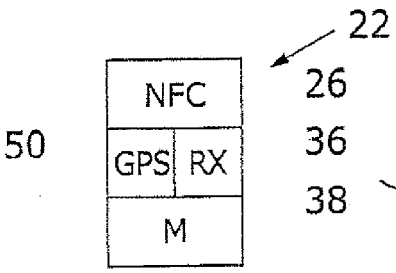
FIGS. 2A and 2B respectively show, in block diagram form, a magnetic field strength meter and a tagger which are used in the blasting system shown in FIG. 1.

FIG. 2A illustrates, in block diagram form, a MFSM 22. The MFSM 22 includes a near field communication (NFC) chip 26, a receiver 36, and a memory module 38 in which various data can be stored.

Figure 2B:
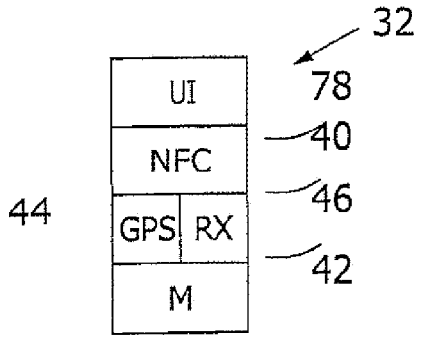

FIG. 2B is a block diagram of a tagger 32 used in the blasting system 10. The tagger 32 includes an NFC chip 40 which is configured to communicate with the respective NFC chip 26 of each MFSM 22 to generate and transfer data, and a memory module 42 in which the data can be stored.

In use of the blasting system 10, a through-the earth magnetic signal (which may be regarded as a test signal) is generated by the blast controller 18 and is transmitted by the transmitter 16 from the antenna 14 at the site 12. The magnetic test signal has a predetermined and known signal strength.

At each of the locations 24, the receiver 36 of the MFSM 22, at that location, in response to receiving the through-the earth magnetic signal obtains a measure of the strength of the received signal. The measure of the strength of the received signal is stored in the memory module 38 of the MFSM 22 together with an identifier for that MFSM. The identifier is linked with the measure of the strength of the received signal so that the data obtained by each MFSM 22 is distinguishable from the data obtained by any other MFSM.

To establish the blasting system, the user 34 with the tagger 32 moves between the locations 24 and, at each location 24, scans the respective MFSM 22 to produce positional data of that location. The scanning is performed by bringing the NFC chip 40 of the tagger 32 in proximity to the NFC chip 26 of the MFSM 22 to allow communication and data transfer to take place.

In one form of the invention the tagger 32 includes a GPS module 44 which is operable to produce positional data of each location 24 upon scanning the respective MFSM 22. Simultaneously data on the identifier and the associated measure of the strength of the received signal are transferred from the MFSM 22 to the tagger 32. The data is stored in the memory module 42 of the tagger 32.

In another form of the invention, which is useful when no GPS signals can reach the site 12 from GPS satellites e.g. when the site 12 is positioned underground and underground blasting is to take place, the tagger 32 includes a receiver 46 which is responsive to signals from beacons 48 which are placed at spaced apart and known locations. The beacon signals are then used by the tagger 32 when scanning an MFSM 22, to produce the required positional data of the MFSM 22 through the use of trilateration or triangulation techniques. The positional data together with the identifier and the measure of the strength of the received magnetic signal are stored in the memory module 42 of the tagger 32. Thus the tagger 32 may determine positional data through the use of a GPS module 44 or a receiver 46 which is responsive to beacon signals, or both techniques can be employed.

It is also contemplated that each MFSM 22 can include a respective GPS module 50, or that the respective receiver 36 can be configured to be responsive to beacon signals. The process of recording the positional data remains the same in that the user 34 moves between the locations 24 and, at each location, scans the respective MFSM 22. The positional data determining means of the MFSM 22 provides the positional data of the location 24 of the MFSM and that data is transferred, together with the identifier and the measure of the strength of the received signal, from the MFSM 22 to the tagger 32 for storage in the memory module 42 of the tagger 32.

The process is repeated by the user 34 until all the MFSMs 22 have been scanned. The user 34 then transfers the stored data 51, from the tagger, to a processor 52, at a data collection point 54, which is configured to use the positional data and the measures of the received signal strengths to define an operative zone 56 (enclosed by a dotted line in FIG. 1) within which each of the measures of the received signal strength is above a threshold value.

Figure 3:
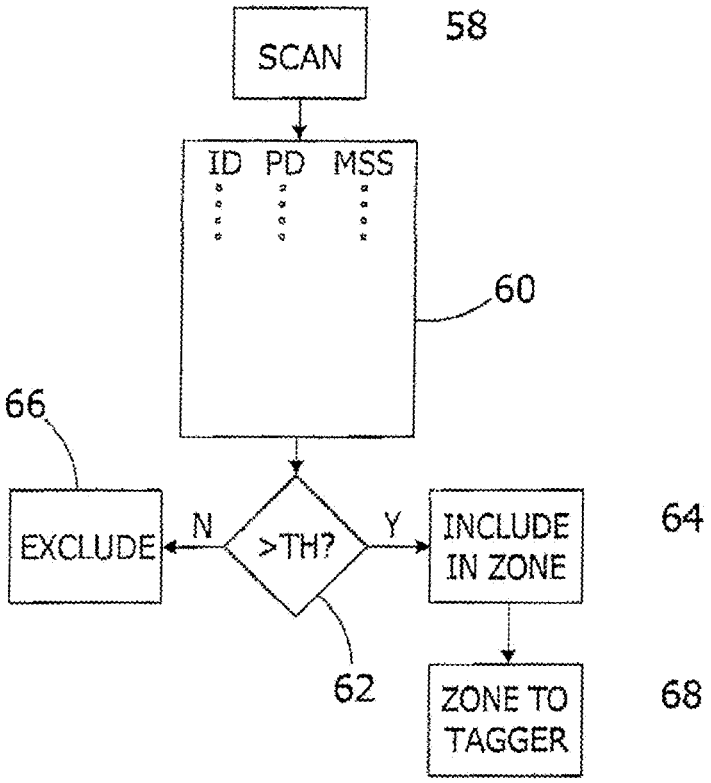
FIG. 3 and FIG. 4 are flow charts of steps which are used in the method of the invention.

FIG. 3 is a flow chart of steps in the definition of the operative zone 56. The user 34 uses the tagger 32 to scan (58) an NFC chip 59, at the data collection point 54, and to transfer the stored data to the processor 52. The data are arranged in associated groups 60, with each group containing an identifier (ID) and a measure (MSS) of the received signal strength at each MFSM 22 and the positional data (PD) of the MFSM.

The processor 52 analyses (62) each group of data to determine whether the measure of the received signal strength is above the threshold value (TH) and, if it is above, the associated positional data of that group is included (64) in the operative zone 56. If the measure of the received signal strength is below the threshold value, then the associated positional data of that group is excluded (66) from the operative zone 56. This process is repeated until all the groups of data have been analyzed (62) by the processor 52. Details of the operative zone 56 are then transferred (68) to the tagger 32 which stores that information in its memory module 42.

The threshold value (TH) is set such that a detonator assembly 30 can reliably receive a fire command signal which is transmitted from the blast controller at a strength which is equal to or greater than the predetermined strength of the test signal. Thus, the signal strength of the received fire command signal will be above the threshold value at the respective borehole 28 in which the detonator assembly is to be deployed. However there is no certainty that the detonator assembly 30 would be capable of reliably receiving the command signal if the received signal strength were below that threshold value.

A plurality of detonator assemblies 30 to be deployed at the site 12 are then loaded into the respective boreholes 28. The tagger 32 with details of the operative zone 56 stored therein is used to scan each detonator assembly 30. Each detonator assembly 30 is tagged if its position is within the operative zone 56. If the physical position of the detonator assembly 30 is outside the operative zone 56 then the detonator assembly 30 is not tagged and it is not included in the blasting plan.

Figure 4:
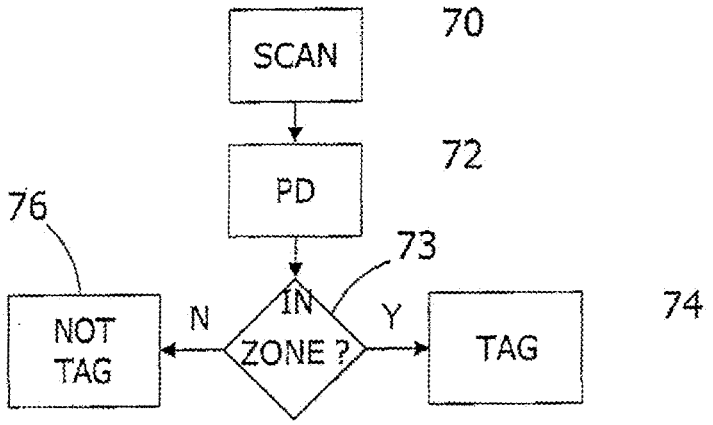

FIG. 4 depicts how the tagging is performed. The user 34 scans (70) each detonator assembly 30 to establish positional data 72 of the detonator assembly 30. The positional data 72 is determined in a manner similar to that described hereinbefore with reference to the MFSMs 22. If the positional data 72 of the detonator assembly 30 being scanned falls within the operative zone 56 (73), then tagging (74) is allowed. However if the positional data of the detonator assembly 30 falls outside the operative zone 56, then tagging is prohibited (76). "Tagging" in this context refers to allowing the detonator assembly 30 to form a part of the blasting system 10 such that it is able to receive and process a command signal from the blast controller. System checks and delay time periods may also be done or assigned when tagging takes place.

A user interface 78 of the tagger 32 provides a positive signal which confirms that tagging has taken place, or a negative signal which indicates that tagging has been declined. If tagging is allowed the detonator assembly 30 is loaded into the respective borehole 28. If tagging is not performed, then the user 34 does not load the detonator assembly 30 into the borehole 28.

This process is repeated so that only those boreholes 28 which are located inside the operative zone 56 are loaded with detonator assemblies. All the detonator assemblies 30 which are successfully tagged are included in a blast plan for the operative zone 56.

If the tagger 32 does not include positional data determining means such as a GPS, or a beacon signal receiver, then that capability is provided in each detonator assembly.

Prior to transmitting the through-the-earth magnetic signal (the test signal) from the antenna 14, the physical position of the input terminals 20 of the antenna 14 is determined e.g. by scanning an NFC chip 80 located at the input terminals 20 with the tagger 32 and using the positional data determining means of the tagger 20 to generate the positional data of the terminals. If the tagger 32 does not include positional data determining means the input terminals 20 are provided with a positional data determining module 82. The tagger 32 is used to scan the NFC chip 80 and the positional data determining module 82 generates positional data which are stored in the memory 42 of the tagger 32. The positional data corresponds with the original position of the antenna 14. The physical layout of the antenna is also recorded so that when required the antenna can be placed in the same physical configuration to ensure repeatability of operation.

The through-the-earth magnetic signal of a predetermined signal strength (the test signal) is sent from the antenna 14, and the MFSMs 22 and the detonator assemblies 30 are scanned as described hereinabove. The size and shape of the area of the operative zone 56 are dependent inter alia on the predetermined signal strength and the threshold value of the received signal strength.

Prior to the blast controller 18 transmitting the fire command signal from the antenna 14, the current positional data of the antenna 14 are obtained by the tagger 32. The original positional data of the antenna and the current positional data of the antenna 14 are correlated. Additionally, the signal strength of the transmitted command signal is controlled to be the same as or greater than the predetermined signal strength of the through-the-earth magnetic signal (the test signal).

At the antenna the positional data determining module 82 may comprise a GPS module, a receiver responsive to beacon signals, an accelerometer which functions relative to a defined location, an NFC chip which can be scanned by a tagger with positional data determining means, or the like. The function of the positional data determining module 82 is to ensure that the position of the antenna does not change from the position which prevailed when the operative zone 56 was defined. This ensures that the operative zone 56 remains unaltered.

The use of reproducible data (i.e. known signal strength and known antenna position) ensures that the positions at which the detonator assemblies can successfully be deployed and incorporated into a blasting plan are accurately known.

Figure 5:
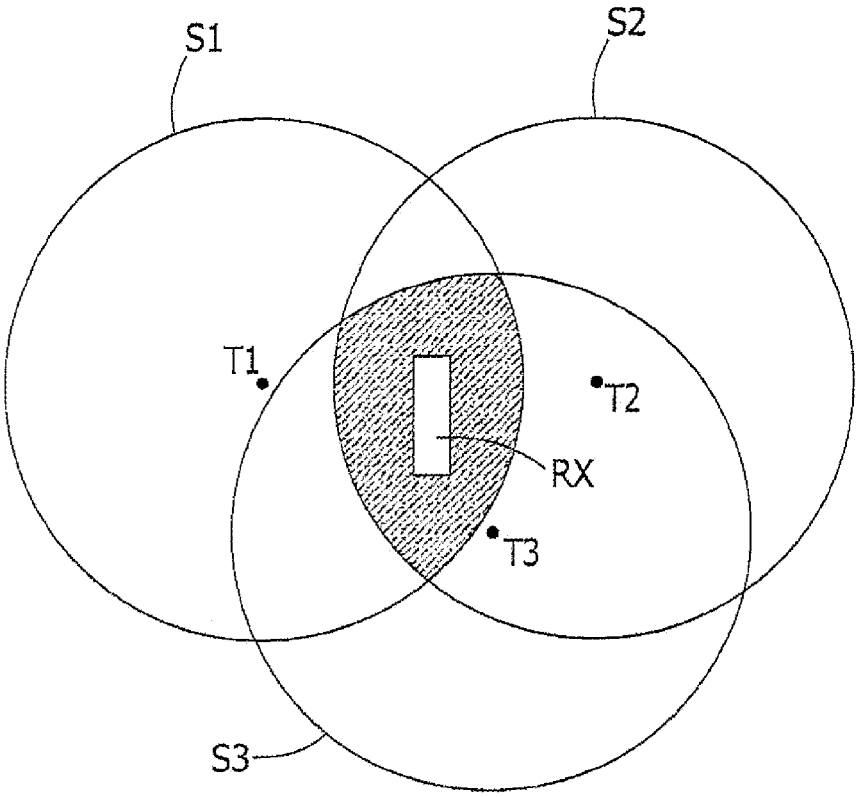
FIG. 5 depicts a technique for obtaining positional data.

FIG. 5 illustrates one technique which can be used to ensure that a detonator assembly can only be deployed if it is correctly positioned within an operative zone.

Use is made of three (or more) time-synchronised transmitters T1, T2 and T3 which transmit at different times. A receiver (RX) in a detonator assembly can determine the relative position of the detonator assembly based on the received signal strength from each of the transmitters T1, T2 and T3. Each transmitter radiates in a spherical fashion and the envelope of each transmitted signal is designated S1, S2 and S3. In FIG. 5 the arrangement is shown in two dimensions although in reality it is three-dimensional.

The receiver RX of the detonator assembly can only be programmed i.e. form a part of a blast plan if the received signal strength of each of the transmitters T1, T2 and T3 is within a prescribed limit. In this instance the area marked OZ is an operative zone as referred to hereinbefore.

The arrangement shown in FIG. 5 allows for the blast command signal to come from a blast controller which is positioned at the location of any of the transmitters T1, T2 and T3. This is a variation of the process described hereinbefore wherein a single test signal is sent from a defined location and a blast command signal is subsequently sent from that defined location.

The invention claimed is:

1. A method of managing a blasting system at a site which includes the steps of:

deploying an antenna at a predetermined position at the site, determining original positional data of the antenna's said predetermined position, logging said original positional data, transmitting a through-the-earth magnetic signal of a predetermined signal strength from the antenna, at each of a plurality of spaced apart locations at the site, obtaining positional data of the location, and obtaining a measure of the strength of the through-the-earth magnetic signal received at the location, using the positional data of the locations and the measures of the received signal strength to define an operative zone, at the site, within which operative zone each of the measures of the received signal strength is above a threshold value, deploying a plurality of detonator assemblies at spaced apart positions at the site, allowing a detonator assembly to be tagged and thereby to be included in the blasting system only if the position of the detonator assembly is situated within the operative zone, again deploying the antenna at said predetermined position at the site, determining a current positional data of the again deployed antenna, comparing the current positional data of the antenna to said original positional data, and only if the current positional data and said original positional data correlate, transmitting from the antenna to each tagged detonator assembly a fire command signal which has a signal strength which is equal to or greater than said predetermined signal strength.

2. A method according to claim 1 wherein at each of the plurality of spaced apart locations use is made of at least one magnetic field strength meter (MFSM) which includes a receiver which is responsive to the received through-the-earth magnetic signal thereby to obtain a measure of the strength of that received signal at that location.

3. A method according to claim 2 wherein the measure of the strength of the received magnetic signal and, optionally, the positional data of the location of the MFSM are stored in a memory module of the MFSM.

4. A method according to claim 3 wherein the positional data, for acceptable received signal strength, is used to define a geographical boundary of an operative zone within which detonator assemblies can be reliably deployed.

5. A method according to claim 4 wherein at least one tagger is used to scan each MFSM thereby to read, and then to store in the tagger, the respective positional data of the location of that MFSM.

6. A method according to claim 5 which includes the step of transferring the stored positional data from the tagger to a processor at a data collection point which is configured to use the positional data and the measures of the received signal strength thereby to define the operative zone.

7. A method according to claim 1 which includes the steps of tagging a detonator assembly only if the intended deployment position of the detonator assembly is situated within the operative zone and, thereafter, of deploying the tagged detonator assembly at such deployment position.

* * * * *